United States Patent [19]

Kurauchi et al.

[11] Patent Number: 4,728,545

[45] Date of Patent: Mar. 1, 1988

[54] METHOD OF FORMING METALLIC COATINGS

[75] Inventors: Takeo Kurauchi, Neyagawa; Atsushi Yamada, Yawata; Nobuhisa Sudo, Yokohama; Hidefumi Okuda, Toyonaka, all of Japan

[73] Assignee: Nippon Paint Co., Ltd., Osaka, Japan

[21] Appl. No.: 914,383

[22] Filed: Oct. 2, 1986

[30] Foreign Application Priority Data

Oct. 2, 1985 [JP] Japan ..... 60-220885

[51] Int. Cl.[4] ..... B05D 3/02

[52] U.S. Cl. ..... 427/409; 427/407.1

[58] Field of Search ..... 427/407.1, 409

[56] References Cited

U.S. PATENT DOCUMENTS 4,355,071 10/1982 Chang ..... 427/409 X 4,391,858 7/1983 Batzill ..... 427/407.1

4,403,003 9/1983 Backhouse ..... 427/407.1

4,477,536 10/1984 Wright et al. ..... 427/409 X 4,652,470 3/1987 Das et al. ..... 427/407.1

*Primary Examiner*—Thurman K. Page

*Attorney, Agent, or Firm*—Millen & White

[57] ABSTRACT

Multilayer metallic coating is formed on a substrate by applying a base coating composition containing a metallic pigment, applying a clear top coating composition on the base coating wet-on-wet, and curing both coatings simultaneously. The coating compositions contain a film-forming polymer having a plurality of crosslinkable function groups, a crosslinker an organic liquid diluent, internally crosslinked polymer microparticles and an organic acid catalyst masked with an organic base capable of accelerating the crosslinking reaction between the film-forming polymer and the crosslinker.

17 Claims, No Drawings

METHOD OF FORMING METALLIC COATINGS

BACKGROUND OF THE INVENTION

This invention relates to a method of forming multilayer coatings having metallic glamor.

The exterior of automobile bodies, for example, is finished with a metallic base coating and a clear top coating formed on the base coating for decorative and protective purposes. For higher productivity, the clear top coating is conventionally applied on the base coating wet-on-wet and cured simultaneously with the base coating. This method is highly suitable for in-line coating operation in the automobile industry and gives a high grade finish in terms of appearance, weatherability, solvent and chemical resistances, discoloring resistance and the like.

In order to achieve excellent appearance, particularly excellent metallic glamor, it is imperative that the top coat applied on the base coat wet-on-wet does not cause intermixing of the two layers which, if it occurs, greatly impairs the orientation of metallic flakes and the metallic glamor. For this reason, attempts have been made to decrease the compatibility between the base coat and the top coat by, for example, using a resin having a higher molecular weight for the base coat than for that of the top coat or by using different resins for different coats such as the combination of acrylic top coat/-polyester or cellulose acetate butyrate base coat. The compatibility between the uncured two coats may also be decreased by modifying the coating conditions thereof. This technique includes two-stage application of the base coat, prolonged rest intervals between application steps, elevation of the viscosity the of base coat relative to the top coat and the like. However, none of these known attempts is completely satisfactory. The use of high molecular weight resins requires a decrease in their solid contents at the time of application. When different resins are used for different coats, the adhesion between different coats is decreased. Modification of coating conditions increases the number of steps and the length of time required for the overall coating operation.

One approach for improving aesthetic properties of multicoat system is to provide a relatively thick top coat on the base coat. In a two coat system comprising a base coat containing aluminum flakes of 10 to 50 μm size, large aluminum flakes often protrude above the base coat surface. The clear top coat therefore must have a film thickness sufficient to compensate for these protrusions. However, with conventional top coat compositions, the film thickness is limited to only 20–30 μm with a single coating operation, or 40–45 μm with two coating operations. This is because conventional coating compositions tend to excessively run with an increase of the amount applied per unit area. Thick top coats may be provided by multiple coating operations. However, this technique is less efficient and requires an extensive modification of existing production lines.

Recently, with the objective of economizing natural resources and energy and because of the requirements for pollution control, much research has been conducted with the objective of for increasing the nonvolatile contents of coating materials. High-solids coating systems are generally formulated by lowering the molecular weight of vehicle resins but this technique, when applied to two coat systems to be applied wet-on-wet, presents several serious problems, such as poor metallic flake orientation, intermixing, poor gloss, excessive run and the like. Another approach would be to incorporate a non-aqueous resin dispersion into the system. However, experiments have shown that this method suffers from the above-mentioned problems because the increase in viscosity after application takes too long time.

We have already proposed in Japanese Laid Open Patent Application No. 60-94175 published May 27, 1985 to incorporate internally crosslinked polymer microgel particles of 0.01 to 10 μm size into both the base coat and top coat compositions. By incorporating the polymer microgel particles, the composition exhibits a yield point such that when a shear force above the yield point is exerted, the composition may be easily fluidized. Once deposited on a substrate, the composition exhibits a high structural viscosity. For this reason, migration of metal flakes in the base coat due to the convection of solvent, intermixing of the two coats and run are prevented, thereby ensuring an excellent finish having improved gloss and other aethetic properties even when the top coat is applied wet-on-wet in a relatively large film thickness.

When relatively low molecular weight resins are used as a vehicles resin in the above multilayer coating system for achieving high solid contents, an acid catalyst is required for accelerating the curing reaction thereof because such vehicle resins are generally less reactive with a cross-linker than higher molecular weight resins.

The use of such acid catalyst is often undesirable because it tends to impair the storage life of the coating compositions. When used excessively, the acid catalyst remains in the finished coating and adversely affects the quality of the finished coating.

SUMMARY OF THE INVENTION

It is an object of the present invention to provide a method of forming a multilayer metallic coating utilizing a high-solids coating system containing low molecular weight vehicle resins, polymer microgel particles and cross-linker without compromising the quality of finished coating and the storage life of the coating system.

The present invention relates to a method of forming a multilayer metallic coating on a substrate which comprises the steps of applying a base coating composition containing a metallic pigment on said substrate, applying a clear top coating composition onto the base coating wet-on-wet, and curing both coatings simultanesouly.

According to the present invention, said base coating composition comprises:

(a) a film-forming, low molecular weight-polymer having a plurality of cross-linkable functional groups, (b) a crosslinker for said film-forming polymer, (c) a volatile organic liquid diluent, (d) internally crosslinked polymer microparticles which are insoluble in the mixture of (a), (b) and (c) but stably dispersible in said mixture, (e) an organic acid catalyst capable of accelerating a crosslinking reaction between (a) and (b), the organic acid catalyst being masked with an organic base, and (f) a metallic pigment.

The clear top coating composition comprises:

(a') a film-forming, low molecular weight-acrylic polymer having a plurality of crosslinkable functional groups, (b) a crosslinker for said film-forming polymer, (c) a volatile organic liquid diluent, (d) internally crosslinked polymer microparticles which are insoluble in the mixture of (a'), (b) and (c) but stably dispersible in said mixture, and (e) an organic acid catalyst capable of accelerating a crosslinking reaction between (a') and (b), the organic acid catalyst being masked with an organic base.

According to the present invention, the use of low molecular weight-vehicle resins in combination with polymer microgel particles both in the base and top coating compositions makes high solids formulations compatible with improved workability thereof. Furthermore, a high crosslinking density sufficient to give a finished coating having excellent film properties may be obtained by the use of the organic acid catalyst masked with an organic base without affecting the stability of coating compositions upon storage.

DESCRIPTION OF THE PREFERRED EMBODIMENTS (a) Film-forming polymer used in the base coating Any conventional polymer having a relatively low molecular weight and a plurality of crosslinkable functional groups such as hydroxyl and carboxyl groups may be employed in the base coating composition. Examples thereof include acrylic resins, alkyd resins and polyester resins having such functional groups and a number average molecular weight of 1,000 to 4,000. These resins preferably have a hydroxyl number of 60 to 200 and an acid number of 5 to 30.

The term "polyester resin" refers to one which is conventionally used in the coating industry and which consists essentially of a condensate of a polyhydric alcohol and a polycarboxylic acid. Also included in this term are alkyd resins modified with higher fatty acid groups derived from natural or synthetic drying, semi-drying or non-drying oils. These polyester resins must have, as hereinbefore described, acid and hydroxyl numbers of a suitable range.

Examples of polyhydric alcohols which may be employed in the synthesis of polyester resins include ethylene glycol, propylene glycol, butylene glycol, 1,6-hexylene glycol, neopentyl glycol, glycerol, trimethylolpropane, trimethylolethane, pentaerythritol, di-pentaerythritol, tri-pentaerythritol, hexanetriol, oligomers of styrene and allyl alcohol (e.g. one commercially available from Monsanto Chemical Company under the name of HJ 100), polyether polyols derived from trimethylolpropane and ethylene oxide and/or propylene oxide (e.g. one commercially available under the name of Niax Triol) and the like.

Examples of polycarboxylic acids include succinic, adipic, azelaic, sebacic, maleic, fumaric, muconic, itaconic, phthalic, isophthalic, terephthalic, trimellitic, pyromellitic acids and their acid anhydrides.

Examples of oils from which higher fatty acids are derived include linseed oil, soybean oil, tall oil, dehydrated castor oil, fish oil, tung oil, saflower oil, sunflower oil and cotton seed oil. Preferably the oil length of oil-modified alkyd resins does not exceed 50%. In order to give an internal plasticity, polyester resins may include a monocarboxylic acid such as a $C_4$–$C_{20}$ saturated aliphatic monocarboxylic acid, benzoic acid, p-tert.-butyl-benzoic acid and abietic acid.

Acrylic polymers which may be used in the base coating composition include those conventionally used in the coating industry and consisting essentially of copolymers of a mixture of a alkyl ester of acrylic or methacrylic acid and a comonomer having a crosslinkable functional group optionally containing an ethylenically unsaturated comonomer other than the former two monomers.

Examples of preferable alkyl (metha)acrylates include methyl (meth)acrylate, ethyl (meth)acrylate, propyl (meth)acrylate, butyl (meth)acrylate and 2-ethylhexyl (meth)acrylate.

Examples of monomers having a cross-linkable group include acrylic acid, methacrylic acid, 2-hydroxyethyl (meth)acrylate, 2-hydroxypropyl (meth)acrylate, N-butoxymethyl(meth)acrylamide, glycidyl (meth)acrylate and the like.

Examples of other monomers which may be optionally present in the monomer mixture include vinyl acetate, acrylonitrile, styrene, vinyl toluene and the like.

The monomer mixture may be polymerized by any known method such as solution polymerization, non-aqueous dispersion polymerization or bulk polymerization. The emulsion polymerization followed by solvent substitution may also employed.

(a') Acrylic film-forming polymer used in the top coating

Acrylic polymers which may be used in the clear top coating composition may be the same as the hereinbefore discussed acrylic polymers used in the base coating. They must have, of course, a sufficient number of functional groups such as hydroxyl and carboxyl groups available for the reaction with a crosslinker. They preferably have a number average molecular weight of 1,000 to 4,000, a hydroxyl number of 60 to 200 and an acid number of 5 to 30.

(b) Crosslinker

Crosslinkers which may be used in the base and top coatings include aminoplast resins, i.e. condensates of formaldehyde and a nitrogen compound such as urea, thiourea, melamine, benzoguanamine and the like. $C_1$–$C_4$ alkyl ethers of these condensates may also be used. Melamine-based aminoplast resins are preferable.

(c) Organic liquid diluent

The organic liquid diluent used in the base and top coating compositions may be any conventional solvent used in the coating industry for dissolving vehicle resins. Examples thereof include aliphatic hydrocarbons such as hexane, heptane; aromatic hydrocarbons such as toluene and xylene; various petroleum fractions having a suitable boiling point range; esters such as butyl acetate, ethylene glycol diacetate and 2-ethoxyethyl acetate; ketones such as acetone, methyl ethyl ketone and methyl isobutyl ketone; alcohols such as butanol; and mixtures of these solvents.

The resin (a) or (a') may be present in the mixture of the organic liquid diluent and the crosslinker in the form of a solution or a stable dispersion.

(d) Internally crosslinked polymer microgels

The microgel particles incorporated into the coating system of this invention should be internally crosslinked so as to be not soluble but stably dispersible in the coating system and have a microscopic average size. Several method are known to produce microgel particles. One such method commonly referred to as the non-aqueous dispersion (NAD) method comprises polymerizing a mixture of ethylenically unsaturated comonomers including at least one cross-linking comonomer in an organic liquid in which the mixture is soluble but the polymer is insoluble such as aliphatic hydrocarbons to form a non-aqueous dispersion of a cross-linked copolymer.

Alternatively, the microgel particles may be prepared by emulsion-polymerizing a mixture of ethylenically unsaturated comonomers including at least one cross-linking comonomer in an aqueous medium by a conventional method, and then removing water from the emulsion by, for example, solvent substitution, centrifugation, filtering or drying.

One such method is disclosed in U.S. Pat. No. 4,530,946 assigned to the assignee of the present application, the disclosure of which is incorporated herein by reference.

Examples of ethylenically unsaturated comonomers used for the production of microgels include methyl (meth)acrylate, ethyl (meth)acrylate, n-butyl (meth)acrylate, isobutyl (meth)acrylate, 2-ethylhexyl (meth)acrylate, styrene, α-methylstyrene, vinyltoluene, t-butylstyrene, ethylene, propylene, vinyl acetate, vinyl propionate, acrylonitrile, methacrylonitrile, dimethylaminoethyl (meth)acrylate and the like. Two or more comonomers may be combined.

Cross-linking comonomers include a monomer having at least two ethylenically unsaturated bonds in the molecule and the combination of two different monomers having mutually reactive groups.

Monomers having at least two polymerization sites may typically be represented by esters of a polyhydric alcohol with an ethylenically unsaturated monocarboxylic acid, esters of an ethylenically unsaturated monoalcohol with a polycarboxylic acid and aromatic compounds having at least two vinyl substituents. Specific examples thereof include, ethylene glycol diacrylate, ethylene glycol dimethacrylate, triethylene glycol dimethacrylate, tetraethylene glycol dimethacrylate, 1,3 butylene glycol dimethacrylate, trimethylolpropane triacrylate, trimethylolpropane trimethacrylate, 1,4-butanediol diacrylate, neopentyl glycol diacrylate, 1,6-hexanediol diacrylate, pentaerythritol diacrylate, pentaerythritol triacrylate, pentaerythritol tetracrylate, pentaerythritol dimethacrylate, pentaerythritol trimethacrylate, pentaerythritol tetramethacrylate, glycerol diacrylate, glycerol allyloxy dimethacrylate, 1,1,1-tris(hydroxymethyl)ethane diacrylate, 1,1,1-tris(hydroxymethyl)ethane triacrylate, 1,1,1-tris(hydroxymethyl)ethane dimethacrylate, 1,1,1-tris(hydroxymethyl)ethane trimethacrylate, 1,1,1-tris(hydroxymethyl)propane diacrylate, 1,1,1-tris(hydroxymethyl)propane triacrylate, 1,1,1-tris(hydroxymethyl)propane dimethacrylate, 1,1,1-tris(hydroxymethyl)propane trimethacrylate, triallyl cyanurate, triallyl isocyanurate, triallyl trimellitate, diallyl phthalate, diallyl terephthalate and divinyl benzene.

Combinations of two monomers having mutually reactive groups may be used in place of, or in addition to monomers having two or more polymerization sites. For example, monomers having a glycidyl group such as glycidyl acrylate or methacrylate may be combined with carboxyl group-containing monomers such as acrylic, methacrylic or crotonic acid. Also, hydroxyl group-containing monomers such as 2-hydroxethyl (meth)acrylate, 2-hydroxypropyl (meth)acrylate, hydroxybutyl (meth)acrylate, allyl alcohol or methallyl alcohol may be combined with isocyanato group-containing monomers such as vinyl isocyanate or isopropenyl isocyanate. Other combination will be apparent to those skilled in the art.

Polymer microgel particles prepared in an aqueous or non-aqueous medium may be incorporated into the coating composition as such, or they may be separated from the medium by means of a suitable technique such as filtration, spray drying or lyophilization optionally followed by milling to a suitable particle size before incorporating to the coating composition.

The polymer microgel particles have an average particle size of 0.01 to 10 μm, preferably from 0.02 to 5 μm.

(e) Masked organic acid catalyst

Acrylic and polyester resins having a plurality of crosslinkable functional groups such as hydroxyl and carboxyl groups are conventionally crosslinked with a crosslinker such as aminoplast resins in the presence of an acid catalyst such as dinonylnaphthalenedisulfonic acid, dodecylbenzenesulfonic acid and p-toluenesulfonic acid.

In the present invention, the acid catalyst takes a masked form with an organic base. By using such masked acid catalyst, it is possible to obtain a high cross-linking density sufficient to impart the resulting coating film with high strength properties even when less reactive, low molecular weight resins are used. The masked acid catalyst does not affect the storage stability of the coating compositions containing the same. Also it minimizes drawbacks of free acid catalyst such as decrease in the quality of finished coatings when remained therein.

Examples of organic acids include an organic acid, particularly sulfonic acid having a pKa below 4, e.g. p-toluenesulfonic acid, dodecylbenzenesulfonic acid, dinonylnaphthalenesulfonic acid, methanesulfonic acid and the like.

The organic acid should be neutralized or masked with at least 60% equivalents of an organic base. Examples of organic bases used for this purpose include secondary or tertiary amines such as dimethylamine, diethylamine, piperidine, morpholine, diethanolamine, methyl ethanolamine, triethylamine, triethanolamine, diisopropanolamine, pyridine, di-2-ethylhexylamine, N,N-dicyclohexylmethylamine, N,N-dimethylcyclohexylamine, di-(N-methyl-2,2,6,6-tetramethyl-4-piperidyl)sebacate and the like. Among them, strongly basic amines having a high boiling point (above 150° C.) such as diisopropanolamine and N,N-dicyclohexylmethylamine are preferable. They give a high grade appearance to the finished coating.

The organic acid and the masking base may be incorporated as a salt therebetween or separately.

Coating compositions

The coating compositions used in the present invention may contain, in addition to hereinbefore described components, other conventional additives as desired. Examples thereof include viscosity adjusting agents such as organic montmorillonite and cellulose acetate butyrate, surface conditioners such as silicones and organic polymers, UV absorbing agents, hindered amines and hidered phenols.

The base coating composition must contain a metallic pigment such as aluminum flakes, copper flakes and bronze flakes. The base coating composition may additionally contain a conventional color pigment.

The ratio of the film-forming resin to the crosslinker in the base and top coating compositions preferably ranges from 4:6 to 8:2 by weight on dry basis. If the amount of crosslinker is too small, the resulting cured film will have poor strength properties. Conversely, excessive amounts of crosslinker will result in a non-flexible, brittle film.

The proportion of polymer microgel particles in the coating compositions generally ranges from 1 to 40% by weight of the combined solid contents of the film-forming polymer and the crosslinker. The desired rheology control function of the microgel particles cannot be expected when the proportion thereof is less than the lower limit, while the apperance of multilayer coating will be degraded at a proportion greater than the upper limit.

The proportion of the amine-masked organic acid catalyst preferably ranges from 0.01 to 3.0% by weight of the total solid contents of the respective coating compositions exclusive of pigments. Too small proportions are not effective to catalize the crosslinking reaction, while too large proportions will adversely affect the appearance, strength and other properties of the resulting film.

One of advantages of the coating compositions used in the present invention resides in the fact that the composition may have a higher nonvolatile content compared with conventional compositions. For example, conventional base coating compositions and top coating compositions generally have a non-volatile content of 23–30% and 38–40% by weight, respectively, whereas corresponding compositions used in the present invention may have a nonvolatile content as high as 51–56% and 59–65% by weight, respectively. This enables to lower their organic solvent content.

The maximum film thickness at which conventional coating compositions may be applied by spraying without run lies at about 45 μm, whereas the coating compositions used in the present invention may be applied in a film thickness as thick as 50–60 μm without run. The weatherability of the resulting cured film is generally comparable with conventional coating compositions.

In the coating operation according to the present invention, the base coating composition is first applied on a substrate which has been previously given a primer or otherwise surface-treated. The material from which the substrate is made is not limited to metals used for manufacturing automobiles such as iron, aluminum and copper but include ceramics, plastics and other materials provided that they can withstand an elevated temperature at which the multilayer coating of the present invention is finally cured. After setting the applied base coating composition at room or elevated temperature, the clear top coating composition is applied wet-on-wet followed by setting or preheating. The multilayer coating so applied consisting of the base and top coating layers is then cured together simultaneously at an elevated temperature to give a cured coating having a high grade finish.

The following examples illustrate the invention. All parts and percents therein are by weight unless otherwise specified.

EXAMPLES

Part I. Preparation of Microgels

Microgel Preparation 1

(a) Preparation of Emulsifier

To a two liter flask having a stirring means, a reflux condenser, temperature-control means, a nitrogen gas-introducing tube and a decanter were added 134 parts of N,N-bis(hydroxyethyl)taurine, 130 parts of neopentyl glycol, 236 parts of azelaic acid, 186 parts of phthalic anhydride, and 27 parts of xylene. The mixture was refluxed and water was removed as an azeotropic mixture with xylene. The temperature was raised to 190° C. over 2 hours and the reaction was continued with stirring until an acid number of 145 was reached.

The reaction product was cooled to 140° C. and 314 parts of CARDURA E-10 (glycidyl versatate, Shell Chemical Company) was added dropwise over 30 minutes at 140° C. The reaction was continued for additional two hours with stirring. A polyester resin having an acid number of 59, a hydroxyl number of 90 and a number average molecular weight ($\overline{Mn}$) of 1054 was obtained.

(b) Preparation of Microgel

To a one liter flask provided with stirring means, cooling means and temperature-control means were added 282 parts of deionized water, 10 parts of the above-described emulsifier and 0.75 parts of diethanolamine at 80° C. The mixture was stirred to make a solution. To the solution was added a solution of 4.5 parts of azobiscyanovaleric acid and 4.3 parts of dimethylethanolamine in 45 parts of deionized water. Then a monomer mixture consisting of 70.7 parts of methyl methacrylate, 94.2 parts of n-butyl acrylate, 70.7 parts of styrene, 30.0 parts of 2-hydroxyethyl acrylate and 4.5 parts of ethylene glycol dimethacrylate was added dropwise over 60 minutes. After the addition of monomers, a solution of 1.5 parts of azobiscyanovaleric acid and 1.4 parts of dimethylethanolamine in 15 parts of deionized water was added. The mixture was stirred at 80° C. for 60 minutes to give a polymeric emulsion having a nonvolatile content of 45%, a pH of 7.2, a viscosity of 92 cps (25° C.) and a particle size of 0.156 microns.

This emulsion was spray dried to obtain microgel particles having a particle size of 0.8 microns.

Microgel Preparation 2

The procedure of Microgel Preparation 1 was followed except that the monomer mixture consisted of 189 parts of methyl methacrylate, 54 parts of n-butyl acrylate and 27 parts of ethyleneglycol dimethacrylate. Particle size of spray dried microgel particles was 1.2 μm.

Microgel Preparation 3

The procedure of Microgel Preparation 1 was followed except that the monomer mixture consisted of 243 parts of n-butyl acrylate and 27 parts of ethyleneglycol dimethacrylate.

Microgel Preparation 4

The procedure of Microgel Preparation 1 was followed to obtain a microgel emulsion except that the monomer mixture consisted of 216 parts of styrene, 27 parts of n-butyl acrylate and 27 parts of ethyleneglycol dimethacrylate.

The resulting emulsion was converted to a microgel dispersion in xylene by azeotropic distillation. A microgel dispersion having a microgel content of 40% was obtained. Particle size was 0.2 μm.

Microgel Preparation 5

To a one liter flask provided with stirring means, cooling means and temperature-control means were added 232 parts of deionized water, 10 parts of the polyester resin obtained in Microgel Preparation 1 (a) and 0.75 parts of dimethylethanolamine with stirring at 80° C. to make a solution. To the solution was added a solution of 1.0 part of azobiscyanovaleric acid and 0.26 parts of dimethylethanolamine in 20 parts of deionized water. Then a monomer mixture consisting of 108 parts of methyl methacrylate and 27 parts of ethyleneglycol dimethacrylate was added dropwise over 60 minutes. After the addition of monomers, a solution of 0.5 parts of azobiscyanovaleric acid and 0.3 parts of dimethylethanolamine in 25 parts of deionized water was added. Then a monomer mixture consisting of 9.5 parts of styrene, 20 parts of methyl methacrylate, 14 parts of n-butyl acrylate and 6 parts of ethyleneglycol dimethacrylate was added dropwise over 60 minutes. A solution of 1.5 parts of azobiscyanovaleric acid and 1.4 parts of dimethylethanolamine in 15 parts of deionized water was added again. The mixture was stirred at 80° C. for 60 minutes to complete the polymerization. A microgel emulsion having a nonvolatile content of 45%, a pH of 7.2, a viscosity of 105 cps (25° C.) and a particle size of 0.2 μm was obtained.

The emulsion was converted to a microgel dispersion in xylene having a microgel content of 40% as in Microgel Preparation 4. Particle size in this dispersion was 0.25 μm.

Microgel Preparation 6 (NAD method)

Step (a)

To a flask having a stirring means, a thermometer and a reflux condenser were added the following stock materials:

| | |
|---|---|
| Aliphatic hydrocarbons (b.p. 140–156° C., free from aromatic hydrocarbons) | 20.016 parts |
| Methyl methacrylate | 1.776 parts |
| Methacrylic acid | 0.036 parts |
| Azobisisobutyronitrile | 0.140 parts |
| 33% solution of graft copolymer stabilizer (see below) | 0.662 parts |

The interior of the flask was purged with nitrogen gas and the contents thereof were maintained at 100° C. for 1 hour to produce a seed dispersion.

To the flask was added a monomer mixture having the following composition in portions with stirring at 100° C. over 6 hours.

| | |
|---|---|
| Methyl methacrylate | 32.459 parts |
| Glycidyl methacrylate | 0.331 parts |
| Methacrylic acid | 0.331 parts |
| Azobisisobutyronitrile | 0.203 parts |
| Dimethylaminoethanol | 0.070 parts |
| 33% solution of graft copolymer stabilizer (see below) | 6.810 parts |
| Aliphatic hydrocarbons (b.p. 140–156° C.) | 37.166 parts |

The contents of the flask was kept at 100° C. for additional 3 hours to convert the monomer mixture to insoluble polymer gel particles (18–19% of total dispersed phase) and uncross-linked polymer particles (19% of total dispersed phase).

The graft copolymer stabilizer solution used in the above procedure was prepared by self-condensing 12 hydroxystearic acid to an acid number of 31–34 mg KOH/g (corresponding to a molecular weight from 1650–1800), reacting the condensate with a stoichiometric amount of glycidyl methacrylate, and then copolymerizing 3 parts of the resulting unsaturated ester with 1 part of a 95:5 mixture of methyl methacrylate/acrylic acid.

Step (b)

The same flask as used in Step (a) was charged with 63.853 parts of the dispersion produced in Step (a) and the content was heated at 115° C. After purging the interior of the flask with nitrogen gas, a monomer mixture having the following composition was added in portions with stirring at 115° C. over 3 hours.

| | |
|---|---|
| Methyl methacrylate | 3.342 parts |
| Hydroxyethyl acrylate | 1.906 parts |
| Methacrylic acid | 0.496 parts |
| Butyl acrylate | 3.691 parts |
| 2-Ethylhexyl acrylate | 3.812 parts |
| Styrene | 5.712 parts |
| Azobisisobutyronitrile | 0.906 parts |
| n-Octylmercaptan | 0.847 parts |
| 33% solution of graft copolymer stabilizer (see above) | 1.495 parts |

After the completion of the addition, the contents were maintained at 115° C. for additional 2 hours to allow the mixture to fully react. The resulting product was diluted with 13.940 parts of butyl acetate to obtain 100 parts of a non-aqueous dispersion having a total film-forming solid content of 45% and an insoluble polymer microgel content of 27.0%. The particle size was 0.08 μm.

Part II. Synthesis of Vehicle Resins

Resin Synthesis 1

A reactor provided with a stirrer, reflux condenser, a thermometer, a nitrogen gas-introducing tube and a drip fannel was charged with 220 parts of SOLVESSO 100 and heated to 150° C. while introducing nitrogen gas. To the reactor was added the following monomer mixture (a) over 3 hours at a constant rate.

| Monomer Mixture (a) | |
|---|---|
| Ethyl acrylate | 307 parts |
| Ethyl methacrylate | 292 parts |
| 2-Hydroxyethyl methacrylate | 116 parts |
| PLACCEL FM-1[1] | 217 parts |
| Methacrylic acid | 18 parts |
| 2,4-Diphenyl-4-methyl-1-pentene | 50 parts |
| Azobisisobutyronitrile | 30 parts |
| t-Butylperoxy-2-ethylhexanoate | 150 parts |

[1]Sold by Daicel Chemical Industries, Ltd. A 1:1 adduct of 2-hydroxyethyl methacrylate and ε-caprolactone.

After the addition, the mixture was kept at 150° C. for 30 minutes. Then 10 parts of t-butylperoxy-2-ethylhexanoate and 30 parts of SOLVESSO were added dropwise over 1 hour at a constant rate. Then the reaction mixture was kept at 150° C. for 3 hours and cooled to obtain Resin Solution A having a nonvolatile content of 80%, an $\overline{Mn}$ of 1,000 and viscosity X.

Resin Synthesis 2

To a reactor provided with a stirrer, a thermometer, a water trap and a nitrogen-gas introducing tube were added 3.69 parts of trimethylolpropane, 17.21 parts of neopentylglycol, 34.39 parts of pivaleic acid neopentylglycol ester, 22.99 parts of hexahydrophthalic anhydride, 21.72 parts of adipic acid, 0.02 parts of dibutyltin oxide and 2 parts of xylene. The mixture was reacted at 230° C. under nitrogen gas current while stirring until an acid number of 10.0 mg KOH/g of solid content was reached. After cooling, the reaction product was diluted with 21 parts of xylene to obtain Resin Solution B having a nonvolatile content of 80%, an $\overline{Mn}$ of 1,200 and viscosity Z 2.

Resin Synthesis 3

The procedure of Resin Synthesis 1 was repeated except that the amount of 5-butylperoxy-2-ethylhexanoate was decreased from 150 parts to 60 parts. Resin Solution C having a nonvolatile content of 80%, an $\overline{Mn}$ of 1,800 and viscosity Z 5 was obtained.

Resin Synthesis 4

The same reactor as used in Resin Synthesis 1 was charged with 400 parts of xylene and heated to 130° C. while introducing nitrogen gas. To the reactor was added the following monomer mixture (b) over 3 hours at a constant rate.

| Monomer Mixture (b) | |
|---|---|
| Ethyl acrylate | 307 parts |
| Ethyl methacrylate | 292 parts |
| Styrene | 50 parts |
| 2-Hydroxyethyl methacrylate | 116 parts |
| PLACCEL FM-1 | 217 parts |
| Methacrylic acid | 18 parts |
| t-Butylperoxy-2-ethylhexanoate | 80 parts |

After the addition, the mixture was kept at 130° C. for 30 minutes. Then a mixture of 10 parts of t-butylperoxy2-ethylhexanoate and 10 parts of xylene was added dropwise over 1 hour at a constant rate. The reaction mixture was kept at 130° C. for 3 hours and cooled to obtain Resin Solution D having a nonvolatile content of 70%, an $\overline{Mn}$ of 4,000 and viscosity Z 1.

Resin Synthesis 5

The procedure of Resin Synthesis 4 was repeated except that 80 parts of t-butylperoxy-2-ethylhexanoate were replaced by 30 parts of azobisisobutylronitrile. Resin Solution E having a nonvolatile content of 70%, an $\overline{Mn}$ of 4,500 and viscosity Z 3 was obtained.

Resin Synthesis 6

The procedure of Resin Synthesis 1 was followed except that monomer mixture (a) was replaced by the following monomer mixture (c).

| Monomer Mixture (c) | |
|---|---|
| Styrene | 200 parts |
| n-Butyl methacrylate | 191 parts |
| Lauryl methacrylate | 246 parts |
| 2-Hydroxyethyl methacrylate | 232 parts |
| Methacrylic acid | 31 parts |
| 2,4-Diphenyl-4-methyl-1-pentene | 100 parts |
| Azobisisobutyronitrile | 20 parts |
| t-Butylperoxy-2-ethylhexanoate | 60 parts |

Resin Solution F having a nonvolatile content of 80%, an $\overline{Mn}$ of 1,800 and viscosity Z 5 was obtained.

Resin Synthesis 7

The procedure of Resin Synthesis 6 was repeated except that the amount of t-butylperoxy-2-ethylhexanoate was increased from 60 parts to 150 parts.

Resin Solution G having a nonvolatile content of 80%, an $\overline{Mn}$ of 1,000 and viscosity S was obtained.

Resin Synthesis 8

The procedure of Resin Synthesis 4 was repeated except that the amount of t-butylperoxy-2-ethylhexanoate was increased from 60 parts to 100 parts.

Resin Solution H having a nonvolatile content of 80%, an $\overline{Mn}$ of 1,200 and viscosity Y was obtained.

Resin Synthesis 9

The procedure of Resin Synthesis 4 was repeated except that monomer mixture (b) was replaced by the following monomer mixture (d).

| Monomer Mixture (d) | |
|---|---|
| Styrene | 300 parts |
| n-Butyl methacrylate | 191 parts |
| Lauryl methacrylate | 246 parts |
| 2-Hydroxyethyl methacrylate | 232 parts |
| Methacrylic acid | 31 parts |

-continued

| Monomer Mixture (d) | |
|---|---|
| t-Butylperoxy-2-ethylhexanoate | 100 parts |

Resin Solution I having a nonvolatile content of 70%, an $\overline{Mn}$ of 3,500 and viscosity Y was obtained.

Resin Synthesis 10

The procedure of Resin Synthesis 9 was repeated except that the amount of t-butylperoxy-2-ethylhexanoate was decreased from 100 parts to 70 parts.

Resin Solution J having a nonvolatile content of 70%, an $\overline{Mn}$ of 4,500 and viscosity Z 4 was obtained.

Resin Synthesis 11

The procedure of Resin Synthesis 4 was repeated except that the amount of t-butylperoxy-2-ethylhexanoate was increased from 80 parts to 90 parts.

Resin Solution L having a nonvolatile content of 70%, an $\overline{Mn}$ of 3,800 and viscosity Z was obtained.

Resin Synthesis 12

The procedure of Resin Synthesis 4 was repeated except that the amount of t-butylperoxy-2-ethylhexanoate was increased from 80 parts to 120 parts.

Resin Solution K having a nonvolatile content of 70%, an $\overline{Mn}$ 3,000 and viscosity V was obtained.

Resin Synthesis 13

The procedure of Resin Synthesis 9 was repeated except that the amount of t-butylperoxy-2-ethylhexanoate was decreased from 100 parts to 70 parts.

Resin Solution N having a nonvolatile content of 70%, an $\overline{Mn}$ of 3,800 and viscosity Z was obtained.

Resin Synthesis 14

The procedure of Resin Synthesis 9 was repeated except that the amount of t-butylperoxy-2-ethylhexanoate was increased from 100 parts to 120 parts.

Resin Solution M having a nonvolatile content of 70%, an $\overline{Mn}$ of 3,000 and viscosity W was obtained.

Part III. Base Coating Compositions

| Coating Composition A | |
|---|---|
| Resin solution A of Synthesis 1 | 60 parts |
| NIKALAC Mx-45 | 32 parts |
| Microgel preparation 2 | 25 parts |
| ALUPASTE 7160N | 23 parts |
| SEESORB 103 | 2 parts |
| SANOL LS440 | 0.3 parts |

The above ingredients were weighed to a stainless steel container and thoroughly mixed by a laboratory mixer.

A masked organic acid solution consisting of 1.5 parts of p-toluene-sulfonic acid and 0.5 parts of triethylamine in 2.25 parts of isopropanol was added to the above composition.

| Coating Composition B | |
|---|---|
| Resin solution B of Synthesis B | 61.5 parts |
| NIKALAC Mx-470 | 50 parts |
| Microgel preparation 3 | 15 parts |
| Xylene | 10 parts |
| ALUPASTE 7160N | 23 parts |
| SEESORB 103 | 1.5 parts |
| SANOX LS440 | 0.1 parts |

To a mixture of the above ingredients was added a masked organic acid solution consisting of 0.8 parts of p-toluenesulfonic acid, 0.5 triethylamine and 1 part of dicyclohexylmethylamine in 1.2 parts of isopropanol.

| Coating Composition C | |
|---|---|
| Resin solution C of Synthesis 3 | 53.1 parts |
| SOLVESSO 100 | 15 parts |
| FASTOGEN Blue NK | 8 parts |
| CYMEL 1130 | 47.2 parts |
| Microgel preparation 5 | 37.5 parts |
| ALUPASTE 7160N | 9 parts |
| SEESORB 103 | 1 parts |

To the above mixture was added a masked organic acid solution consisting of 1.0 part of dinonylnaphthalenedisulfonic acid and 1.0 part of diisopropanolamine in 1.0 part of isopropanol.

| Coating Composition D | |
|---|---|
| Resin solution K of Synthesis 12 | 67.9 parts |
| NIKALAC Mx-470 | 52.8 parts |
| Microgel preparation 5 | 25 parts |
| Xylene | 10 parts |
| ALUPASTE 7160N | 23 parts |
| SEESORB 103 | 2 parts |
| SANOL LS440 | 0.1 parts |

A masked organic acid solution consisting of 1.0 part of dodecylbenzenesulfonic acid and dicyclohexylmethylamine in 0.7 parts of isopropanol was added to the above mixture.

| Coating Composition E | |
|---|---|
| Resin solution L of Synthesis 11 | 67.9 parts |
| NIKALAC MX-470 | 52.8 parts |
| Microgel preparation 5 | 25 parts |
| Xylene | 10 parts |
| ALUPASTE 7160N | 23 parts |
| SEESORB 103 | 1 parts |
| SANOL LS440 | 0.1 parts |

A masked organic acid solution consisting of 1.0 part of dodecylbenzenesulfonic acid and 1.0 part of dicyclohexylmethylamine in 0.7 parts of isopropanol was added to the above mixture.

| Coating Composition F | |
|---|---|
| Resin solution K of Synthesis 12 | 67.9 parts |
| NIKALAC Mx-470 | 52.8 parts |
| Xylene | 10 parts |
| ALUPASTE 7160N | 23 parts |
| SEESORB 103 | 1 part |
| SANOL LS440 | 0.1 parts |

A masked organic acid solution consisting of 1.0 part of dodecylbenzenesulfonic acid and 1.0 part of dicyclohexylmethylamine in 0.7 parts of isopropanol was added to the above mixture.

| Coating Composition G | |
|---|---|
| Resin solution K of Synthesis 12 | 67.9 parts |
| NIKALAC Mx-470 | 52.8 parts |
| Microgel preparation 5 | 25 parts |
| Xylene | 10 parts |
| ALUPASTE 7160N | 23 parts |
| SEESORB 103 | 2 parts |
| SANOL LS440 | 0.1 parts |
| Acrylic acid | 1 part |

| Coating Composition H | |
|---|---|
| Resin solution L of Synthesis 11 | 96.4 parts |
| U-VAN 20N-60 | 37.5 parts |
| Microgel preparation 5 | 25 parts |
| Xylene | 10 parts |
| ALUPASTE 7160N | 23 parts |
| SEESORB 103 | 1.5 parts |
| SANOL LS440 | 0.1 parts |

A masked organic acid solution consisting of 0.8 parts of p-toluenesulfonic acid and 0.5 parts of triethylamine in 0.7 parts of isopropanolamine was added to the above mixture.

| Coating Composition Q | |
|---|---|
| Resin solution E of Synthesis 5 | 107.1 parts |
| U-VAN 20N-60 | 41.7 parts |
| Xylene | 10 parts |
| ALUPASTE 7160N | 23 parts |
| SEESORB 103 | 1 part |
| SANOL LS440 | 0.1 parts |

Part IV. Clear Top Coating Composition

| Coating Composition I | |
|---|---|
| Resin solution F of Synthesis 6 | 62.5 parts |
| NIKALAC Mx-45 | 50 parts |
| Microgel preparation 4 | 7.5 parts |
| Xylene | 10 parts |
| TINUBIN 900 | 3 parts |
| SANOL LS440 | 0.1 parts |

A masked organic acid solution consisting of 1.0 part of p-toluenesulfonic acid and 1.5 parts of diisopropanolamine in 1.5 parts of isopropanol was added to the above mixture.

| Coating Composition K | |
|---|---|
| Resin solution G of Synthesis 7 | 62.5 parts |
| U-VAN 120 | 50 parts |
| Microgel preparation 1 | 20 parts |
| SOLVESSO 100 | 10 parts |
| TINUBIN 900 | 4 parts |
| SANOL LS440 | 1 part |

A masked organic acid solution consisting of 2 parts of p-toluenesulfonic acid and 1 part of dicyclohexylmethylamine in 3 parts of isopropanol was added to the above mixture.

| Coating Composition L | |
|---|---|
| Resin solution H of Synthesis 8 | 55.6 parts |
| NIKALAC Mx-45 | 50 parts |
| Microgel preparation 5 | 12.5 parts |
| Xylene | 5 parts |
| TINUBIN 900 | 3 parts |
| SANOL LS440 | 2 parts |

A masked organic acid solution consisting of 2 parts of dodecylbenzenesulfonic acid and 0.5 parts of triethylamine in 2 parts of isopropanol was added to the above mixture.

| Coating Composition M | |
|---|---|
| Resin solution F of Synthesis 6 | 75 parts |

-continued

| Coating Composition M | |
|---|---|
| NIKALAC Mx-470 | 44.4 parts |
| Microgel preparation 4 | 12.5 parts |
| Xylene | 5 parts |
| TINUBIN 900 | 2 parts |
| SANOL LS440 | 1 part |

A masked organic acid solution consisting of 1.5 part of p-toluenesulfonic acid and 1 part of diisopropanolamine in 3 parts of isopropanol was added to the above mixture.

| Coating Composition N | |
|---|---|
| Resin solution M of Synthesis 14 | 85.7 parts |
| CYMEL 1130 | 44.4 parts |
| Microgel preparation 1 | 3 parts |
| Xylene | 10 parts |
| TINUBIN 900 | 3 parts |
| SANOL LS440 | 1 part |

A masked organic acid solution consisting of 1 part of p-toluenesulfonic acid and 0.5 parts of triethylamine in 2 parts of isopropanol was added to the above mixture.

| Coating Composition O | |
|---|---|
| Resin solution of Synthesis 13 | 85.7 parts |
| CYMEL 1130 | 44.4 parts |
| Microgel preparation 1 | 2 parts |
| Xylene | 10 parts |
| TINUBIN 900 | 2 parts |
| SANOL LS440 | 1 part |

A masked organic acid solution consisting of 0.5 parts of p-toluenesulfonic acid and 0.3 parts of triethylamine in 1.5 parts of isopropanol was added to the above mixture.

| Coating Composition P | |
|---|---|
| Resin solution N of Synthesis 13 | 100 parts |
| U-VAN 20N-60 | 50 parts |
| Microgel preparation 1 | 2 parts |
| Xylene | 10 parts |
| TINUBIN 900 | 2 parts |
| SANOL LS440 | 1 part |

| Coating Composition R | |
|---|---|
| Resin solution J of Synthesis 10 | 100 parts |
| CYMEL 1130 | 30 parts |

A solution of 1.5 parts of p-toluenesulfonic acid in 3 parts of isopropanol was added to the above mixture.

Part V. Multilayer Coating

EXAMPLES 1

Base coating composition A was diluted with a 50:50 mixture of ethyl acetate and SOLVESSO 50 to a spray viscosity of 15 sec. at 20° C. in Ford cup No. 4. A 1 g sample of this composition was taken on an aluminum plate having known weight and placed in an air-circulating oven at 105° C. for 3 hours. Volatile content was determined by % weight loss in this test. The balance represents nonvolatile (solid) content.

Clear top coating composition I was diluted with a 50:50 mixture of ethyl acetate and SOLUVESSO 50 to a spray viscosity of 30 sec. at 20° C. in Ford cup No. 4. The non-volatile content of this composition was also determined as above.

For each run, two degreased tinned sheet iron specimens were used. One specimen was placed in a horizontal position and the other in a vertical position. Then the specimens were coated once with a diluted base coat composition to a dry film thickness of 15 μm and allowed to set for 3 minutes at room temperature. Then a diluted clear composition was applied once on respective specimens wet-on-wet, allowed to set for 5 minutes at room temperature and baked at 140° C. for 30 minutes. Vertically positioned specimens were provide with a top coat having a gradient dry film thickness from 20 to 60 μm and horizontally positioned specimens were given a uniform top coat having a dry film thickness of 35 μm.

The orientation of the metallic flake pigments and the gloss of the finished coating were determined on the horizontally positioned specimen. The run property of the top coating composition was determined by the maximum film thickness of the top coating at which the composition applied on the vertically positioned specimen did not run.

EXAMPLES 2 THROUGH 10 AND COMPARATIVE EXAMPLES 1 THROUGH 4

The procedure of EXAMPLE 1 was followed using the combinations of the base and top coating compositions described in the tables below.

TABLE I

| Example<br>Base Coating | Example 1<br>Composition A | | Example 2<br>Composition B | | Example 3<br>Composition C | |
|---|---|---|---|---|---|---|
| Resin | Acrylic A | 60.0(48) | Polyester B | 61.5(40) | Acrylic C | 53.1(42.5) |
| Crosslinker | NIKALAC Mx-45[2] | 32 (32) | NIKALAC Mx-45 | 50 (45) | CYMEL[3] | 47.2(42.5) |
| Microgel | Preparation 2 | 25 (20) | Preparation 3 | 15 (15) | Preparation 5 | 37.5(15) |
| Solvent | Xylene | 5 | Xylene | 10 | SOLVESSO[5] | 15 |
| Pigment | ALUPASTE 7160N[6] | 23 | ALUPASTE 7160N | 23 | ALUPASTE 7160N | 9 |
| | | | | | FASTOGEN blue NK[21] | 8 |
| UV absorber | SEESORB 103[7] | 2 | SEESORB 103 | 1.5 | SEESORB 103 | 1.0 |
| Antioxidant | SANOL LS440[8] | 0.3 | SANOL LS440 | 0.1 | | |
| Acid | PTS[9] | 1.5 | PTS | 0.8 | DNNDS[10] | 1.0 |
| Base | TEA[12] | 0.5 | TEA | 0.5 | DIP[14] | 1.0 |
| | | | DCHMA[13] | 1.0 | | |
| Top Coating | | | Composition I | | | |
| Resin | | | Acrylic F | 62.5(50) | | |
| Crosslinker | | | NIKALAC Mx-45 | 50 (50) | | |
| Microgel | | | Preparation 4 | 7.5(3) | | |

TABLE I-continued

| | | |
|---|---|---|
| Solvent | Xylene | 10 |
| UV absorber | TINUBIN[8] | 3.0 |
| Antioxidant | SANOL LS440 | 1.0 |
| Acid | PTS | 1.0 |
| Base | DIP | 1.5 |

| Example<br>Base Coating | Example 4<br>Composition D | | Example 5<br>Composition E | | Comparative Example 1<br>Composition F | | Comparative Example 2<br>Composition G | |
|---|---|---|---|---|---|---|---|---|
| Resin | Acrylic K | 67.9(47.5) | Acrylic L | 67.9(47.5) | Acrylic K | 67.9(47.5) | Acrylic K | 67.9(47.5) |
| Crosslinker | NIKALAC Mx-470 | 52.8(47.5) | NIKALAC Mx-470 | 52.8(47.5) | NIKALAC Mx-470 | 52.8(47.5) | NIKALAC Mx-470 | 52.8(47.5) |
| Microgel | Preparation 5 | 25 (10) | Preparation 5 | 25 (10) | — | | Preparation 5 | 25 (10) |
| Solvent | Xylene | 10 | Xylene | 10 | Xylene | 10 | Xylene | 10 |
| Pigment | ALUPASTE 7160N | 23 | ALUPASTE 7160N | 23 | ALUPASTE 7160N | 23 | ALUPASTE 7160N | 23 |
| UV absorber | SEESORB 103 | 2 | SEESORB 103 | 1 | SEESORB 103 | 2 | SEESORB 103 | 2 |
| Antioxidant | SANOL LS440 | 0.1 | SANOL LS440 | 0.1 | SANOL LS440 | 0.1 | SANOL LS440 | 0.1 |
| Acid | DDBSA[11] | 1.0 | DDBSA | 1.0 | DDBSA | 1.0 | Acrylic acid (pKa4.26) | 1.0 |
| Base | DCHMA | 1.0 | DCHMA | 1.0 | DCHMA | 1.0 | | |
| | Same as preceding examples | | | | | | | |

TABLE II

| Example<br>Base Coating | Example 6 | | Example 7<br>Composition J | | Example 8 | |
|---|---|---|---|---|---|---|
| Resin | | | Acrylic F | 53.1(42.5) | | |
| Crosslinker | | | CYMEL 1130 | 47.2(42.5) | | |
| Microgel | | | Preparation 5 | 37.5(15) | | |
| Solvent | | | Xylene | 10 | | |
| Pigment | | | ALUPASTE 7160N | 23 | | |
| UV absorber | | | SEESORB 103 | 1.5 | | |
| Antioxidant | | | SANOL LS440 | 0.1 | | |
| Acid | | | PTS | 0.8 | | |
| Base | | | TEA | 0.5 | | |
| | | | DCHMA | 0.5 | | |
| **Top Coating** | **Composition K** | | **Composition L** | | **Composition M** | |
| Resin | Acrylic G | 62.5(50) | Acrylic H | 55.6(50) | Acrylic F | 75 (60) |
| Crosslinker | U-VAN 120[4] | 50 (50) | NIKALAC Mx-45 | 50 (50) | NIKALAC Mx-45 | 44.4(40) |
| Microgel | Preparation 1 | 20 (15) | Preparation 4 | 12.5(5) | Preparation 4 | 12.5(5) |
| Solvent | S-100 | 10 | Xylene | 5 | Xylene | 5 |
| UV absorber | TINUBIN 900 | 4 | TINUBIN 900 | 3 | TINUBIN 900 | 2 |
| Antioxidant | SANOL LS440 | 1 | SANOL LS440 | 2 | SANOL LS440 | 1 |
| Acid | PTS | 2 | DDBSA | 2 | PTS | 1.5 |
| Base | DCHMA | 1 | TEA | 0.5 | DIP | 1.0 |

| Example<br>Base Coating | Example 9 | | Example 10 | | Comparative Example 3<br>Composition H | | Comparative Example 4<br>Composition Q | |
|---|---|---|---|---|---|---|---|---|
| Resin | Same as preceding examples | | | | Acrylic E | 96.4(67.5) | Acrylic E | 107.1(75) |
| Crosslinker | | | | | U-VAN 20N-60[4] | 37.5(22.5) | U-VAN 20N-60 | 41.7(25) |
| Microgel | | | | | Preparation 5 | 25 (1) | — | |
| Solvent | | | | | Xylene | 10 | Xylene | 10 |
| Pigment | | | | | ALUPASTE 7160N | 23 | ALUPASTE 7160N | 23 |
| UV absorber | | | | | SEESORB 103 | 2 | SEESORB 103 | 1 |
| Antioxidant | | | | | SANOL LS440 | 0.1 | SANOL LS440 | 0.1 |
| Acid | | | | | — | | — | |
| Base | | | | | — | | — | |
| **Top Coating** | **Composition N** | | **Composition O** | | **Composition P** | | **Composition R** | |
| Resin | Acrylic M | 85.7(60) | Acrylic N | 85.7(60) | Acrylic J | 100 (70) | Acrylic J | 100 (70) |
| Crosslinker | CYMEL 1130 | 44.4(40) | CYMEL 1130 | 44.4(40) | U-VAN 20N-60 | 50 (30) | CYMEL 303 | 30 (30) |
| Microgel | Preparation 1 | 3 (3) | Preparation 1 | 2 (2) | Preparation 1 | 2 (2) | — | |
| Solvent | Xylene | 10 | Xylene | 10 | Xylene | 10 | — | |
| UV absorber | TINUBIN 900 | 3 | TINUBIN 900 | 2 | TINUBIN 900 | 2 | — | |
| Antioxidant | SANOL LS440 | 1 | SANOL LS440 | 1 | SANOL LS440 | 1 | — | |
| Acid | PTS | 1.0 | PTS | 0.5 | — | | PTS | 1.5 |
| Base | TEA | 0.5 | TEA | 0.3 | — | | — | |

TABLE III

| Example | Ex. 1 | Ex. 2 | Ex. 3 | Ex. 4 | Ex. 5 | Comp. Ex. 1 | Comp. Ex. 2 |
|---|---|---|---|---|---|---|---|
| Evaluation | | | | | | | |
| Spray nonvolatiles, base % | 60 | 55 | 50 | 48 | 40 | 49 | 48 |
| Spray nonvolatiles, top % | 53 | 53 | 53 | 53 | 53 | 53 | 53 |
| Storage stability, base[20] | | | | | | | × |
| Pigment orientation[15] | | | | | | × | Δ |
| Maximum film thickness[16] free from run, μm | 43 | 50 | 51 | 50 | 51 | 42 | 41 |
| 60° Gloss[17] | 90 | 95 | 97 | 98 | 97 | 35 | 40 |

TABLE III-continued

| Example | Ex. 1 | Ex. 2 | Ex. 3 | Ex. 4 | Ex. 5 | Comp. Ex. 1 | Comp. Ex. 2 |
|---|---|---|---|---|---|---|---|
| Pencil hardness | F | F-H | F | H | H | HB | 3B |
| PGD value[18] | 0.7 | 0.9 | 0.9 | 0.9 | 0.8 | 0.2 | 0.3 |
| QUV (50-70° C.)[19] | 2600 | 2400 | 3200 | 3100 | 3200 | 2900 | 2900 |

TABLE IV

| Example | Ex. 6 | Ex. 7 | Ex. 8 | Ex. 9 | Ex. 10 | Comp. Ex. 3 | Comp. Ex. 4 |
|---|---|---|---|---|---|---|---|
| Evaluation | | | | | | | |
| Spray nonvolatiles, base % | 50 | 50 | 50 | 50 | 50 | 36 | 35 |
| Spray nonvolatiles, top % | 64 | 58 | 54 | 50 | 45 | 43 | 45 |
| Storage stability, base | | | | | | | × |
| Pigment orientation | | | | | | | × |
| Maximum film thickness free from run, μm | 55 | 38 | 53 | 48 | 40 | 38 | 28 |
| 60° Gloss | 90 | 97 | 95 | 96 | 98 | 96 | 23 |
| Pencil hardness | HB | F | H | H | H | 2B | B |
| PGD value | 0.8 | 0.9 | 0.9 | 0.9 | 0.9 | 0.8 | 0.1 |
| QUV (50-70° C.) | 2800 | 3200 | 2500 | 3300 | 2700 | 1750 | 780 |

Note

[1]Examples 4-6 and 8 using a masking base having a high boiling point gave particularly high grade appearance in terms film flatness and sharpness.

[2]Melamine resin, Sanwa Chemical Co., N.V. >96%

[3]Melamine resin, American Cyanamid Co., N.V. 90%

[4]Melamine resin, Mitsui Toatsu Chemicals Inc., N.V. 60%

[5]Petroleum hydrocarbon solvent, Esso Chemical Co.

[6]Aluminum flake pigment, Toyo Aluminum Co.

[7]Shipro Kasei Co.

[8]Ciba-Geigy AG.

[9]p-Toluenesulfonic acid

[10]Dinonylnaphthalenesulfonic acid

[11]Dodecylbenzenesulfonic acid

[12]Triethylamine

[13]Dicyclohexylmethylamine

[14]Diisopropanolamine

[15]Visually determined.

: Good

Δ : Not good

Δ : Very bad

[16]Maximum film thickness of top coating free from run.

[17]Data measured by a digital glossmeter Model GK-60D, Suga Shikenki K.K., at 60°.

[18]Data measured by a portable visibility glossmeter sold by Nippon Shikisai Kenkyusho.

[19]Data measured by Atlas Yubukon tester sold by Toyo Seiki Co., exposure time at which cracks occurred on the top coating. Exposure cycling condition: Bedewing at 50° C. for 4 hrs. then irradiating with UV at 70° C. for 8 hrs.

[20]Determined by the increase in viscosity measured by Stormer viscometer after placing in an incubator at 50° C. for 10 days.

: Viscosity increase <10 Ku

Δ : Viscosity increase 10 ku-20 ku

× : Viscosity increase >20 ku

[21]Phthalocyanine pigment, Dainippon Ink And Chemicals, Inc.

We claim:

1. In a method of forming a multilayer metallic coating on a substrate comprising the steps of applying a base coating composition comprising a first film-forming polymer having a plurality of cross-linkable functional groups, a cross-linker reactive with said first film-forming polymer, a volatile organic liquid diluent and a metallic pigment on said substrate, applying on the base coating wet-on-wet a clear top coating composition comprising a second film-forming acrylic polymer having a plurality of cross-linkable functional groups, a crosslinker reactive with said second film-forming polymer and a volatile organic liquid diluent, and curing both coatings simultaneously, the improvement wherein said first and second film-forming polymers have a number average molecular weight of from 1,000 to 4,000; and wherein said base coating composition and said top coating composition each contains an amount of internally crosslinked polymer microparticles which are insoluble in the mixture of said film-forming polymer, said cross-linker and said organic liquid diluent but stably dispersible in said mixture, and a catalytically effective amount of an organic acid catalyst which is a combination of an organic sulfonic acid having a pKa below 4.0 and an amount of organic secondary or tertiary amine sufficient to neutralize at least 60% of said sulfonic acid.

2. The method according to claim 1, wherein said first film-forming polymer is a polyester resin.

3. The method according to claim 1, wherein said first film-forming polymer is an acrylic resin having a hydroxyl number from 60 to 200 and an acid number from 5 to 30.

4. The method according to claim 1, wherein said second film-forming acrylic polymer has a hydroxyl number from 60 to 200 and an acid number from 5 to 30.

5. The method according to claim 1, wherein the base coating composition has a 51-56% nonvolatile content and the top coating composition has a 59-65% nonvolatile content.

6. The method according to claim 1, wherein said polymer microparticles have an average particle size from 0.01 to 10 μm.

7. The method according to claim 1, wherein the top and base coats are applied at a film thickness of 50-60 μm.

8. The method according to claim 1, wherein said amine has a boiling point above 150° C.

9. The method according to claim 1, wherein the ratio of said first film-forming polymer to said cross-linker ranges between 4:6 and 8:2 on weight basis.

10. The method according to claim 1, wherein the ratio of said second film-forming polymer to said cross-linker ranges between 4:6 and 8:2 on weight basis.

11. The method according to claim 1, wherein the proportion of said polymer microparticles in respective coating compositions is 1 to 40% by weight of the combined solid contents of said film-forming polymer and said crosslinker.

12. The method according to claim 1, wherein the proportion of said masked organic acid catalyst in respective coating compositions is 0.01 to 3.0% by weight of the combined solid contents of said film-forming polymer, said crosslinker and said polymer microparticles.

13. The method according to claim 1 wherein said first film-forming polymer is a polyester resin having a hydroxy number from 60 to 200 and an acid number from 5 to 30; wherein said second film-forming acrylic polymer has a hydroxy number from 60 to 200 and an acid number from 5 to 30; wherein said polymer microparticles have an average particle size from 0.01 to 10 μm; wherein said amine has a boiling point above 150° C.; wherein the ratio of said first film-forming polymer to said cross-linker ranges between 4:6 and 8:2 on weight basis; and the ratio of said second film-forming polymer to said cross-linker ranges between 4:6 and 8:2 on weight basis.

14. The method according to claim 13, wherein the proportion of said polymer microparticles in respective coating compositions is 1 to 40% by weight of the combined solid contents of said film-forming polymer and said crosslinker.

15. The method according to claim 13, wherein the proportion of said masked organic acid catalyst in respective coating compositions is 0.01 to 3.0% by weight of the combined solid contents of said film-forming polymer, said cross-linker and said polymer microparticles.

16. The method according to claim 13, wherein the base coating composition has a 51–56% nonvolatile content and the top coating composition has a 59–65% nonvolatile content.

17. The method according to claim 16, wherein the top and base coats are applied at a film thickness of 50–60 μm.

* * * * *